United States Patent [19]

Saxton

[11] 4,058,378

[45] Nov. 15, 1977

[54] HEAT TRANSFER DEVICE

[76] Inventor: Forest J. Saxton, 1256 Mitzi Drive, Calistoga, Calif. 94515

[21] Appl. No.: 672,542

[22] Filed: Apr. 1, 1976

[51] Int. Cl.[2] ..... B01D 47/00

[52] U.S. Cl. ..... 55/257 R; 261/118; 261/DIG. 54

[58] Field of Search ..... 55/257 R, 240, 241; 261/116, 76, 78 A, 78 R, 118, DIG. 75, DIG. 54

[56] References Cited

U.S. PATENT DOCUMENTS

| | | | |
|---|---|---|---|
| 1,844,850 | 2/1932 | Harmon | 261/116 |
| 1,922,920 | 8/1933 | Aherne | 261/76 |
| 2,732,192 | 1/1956 | Johnstone et al. | 261/116 |
| 3,029,578 | 4/1962 | Wiemer et al. | 55/257 R |
| 3,785,625 | 1/1974 | Engalitcheff | 261/116 |

*Primary Examiner*—Bernard Nozick

*Attorney, Agent, or Firm*—Melvin R. Stidham

[57] ABSTRACT

A heat transfer system for cooling water, comprising a relatively large air duct which is open to ambient air at the upstream end, where there is situated an annular, coaxial nozzle to jet hot water through a venturi tube toward the downstream end of the air duct. The high velocity stream of water draws air into the low pressure zone to intermix with the finely divided water droplets moving downstream. The water is cooled by transfer of heat of vaporization as well as by transfer from the air itself, whereby water drawn from the downstream end of the air duct is cool enough for recycling.

7 Claims, 4 Drawing Figures

HEAT TRANSFER DEVICE

BACKGROUND OF THE INVENTION

Industrial water is often heated to a level sufficient to cause thermal pollution if returned to the environment. There is a growing concern over ecological damage caused by introduction of industrially heated waters to lakes and streams. Not only does such thermal pollution seriously flaw the body of water as a source of an industrial coolant, but may adversely affect the plant and animal life supported thereby.

Large quantities of water may be used by industry without serious depletion or pollution of the available supply by circulating the heated water through a cooling tower, wherein the water is cooled by transfer of heat to air, with which it is intimately mixed and by heat of vaporization to a small percentage of the water which evaporates. However, this method, which represents the current practice and state of the art, requires the erection of large and elaborate structures with expensive and energy-consuming equipment.

In accordance with present practice, high pressure pumps are required to carry the hot water to the tops of tall structures where it is released to fall through layers of fill material. Since the only function of such high pressure pumps is to deliver the water to the cooling process, without actually playing any part therein, the energy required to operate them is largely wasted.

In addition, mechanical draft cooling towers presently require the employment of very large motors, gear reduction units, and propellers as a means of moving the cooling air through these towers. This equipment represents a major portion of the initial cost of each cooling tower installation, in part because of the cost of the components themselves, and in part due to the location of this heavy equipment at the top of the tower, which necessitates extremely heavy and complex structures to support the static dynamic loads imposed.

Of even greater importance is the continuing cost of operation and the consumption of energy involved in the operation of these motors and fans as the principal means of creating draft, i.e., moving cooling air through the tower. Over the life span of such mechanical draft cooling towers, operating costs represent many times the cost of installation.

OBJECTS OF THE INVENTION

It is an object of this invention to provide a water cooling system which does not require the use of motor driven propellers or fans to generate the flow of cooling air through the cooling process.

It is a further object of this invention to provide a heat transfer system which does not require tall or elaborate structures.

It is a further object of this invention to provide a heat transfer system which does not require pumping the water being cooled to great heights.

It is a further object of this invention to provide a heat transfer system which has a minimum of parts and is relatively inexpensive to construct, operate, and maintain.

Other objects and advantages of this invention will become apparent from the description to follow when read in conjunction with the accompanying drawing.

SUMMARY OF THE INVENTION

In carrying out this invention, I provide a generally horizontal air tunnel which is open at one end to the atmosphere. At the open end I provide an annular nozzle which jets the hot water through a coaxial venturi tube at high velocity to create a low pressure zone within the venturi tube to suck ambient air in through its open end and exhaust a mixture of air and water into the heat exchanger section. The water is directed through a series of screens, tubular dividers and the like to fractionalize the water particles into a relatively fine mist entrained in the air. If desired, the venturi effect can be augmented with blowers or air compressors to draw in more air. A small percentage of the water droplets will evaporate to draw heat of vaporization from the remaining droplets and, in addition, the intimate mixture of the droplets with the flowing air will also result in further heat transfer to the air. At the downstream end of the air tunnel, a series of baffles directs the water droplets downward to a reservoir from which the water is returned to its source, and the air itself is directed upward through a stack to exhaust to the atmosphere.

DESCRIPTION OF PREFERRED EMBODIMENTS

Figure 2:
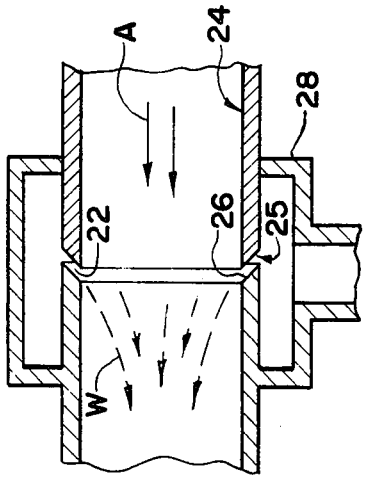
FIG. 2 is an enlarged vertical section of a water nozzle forming a feature of this invention.
Figure 3:
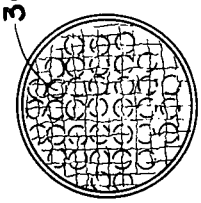
FIG. 3 is a section view taken along line 3—3 of FIG. 1.
Figure 1:
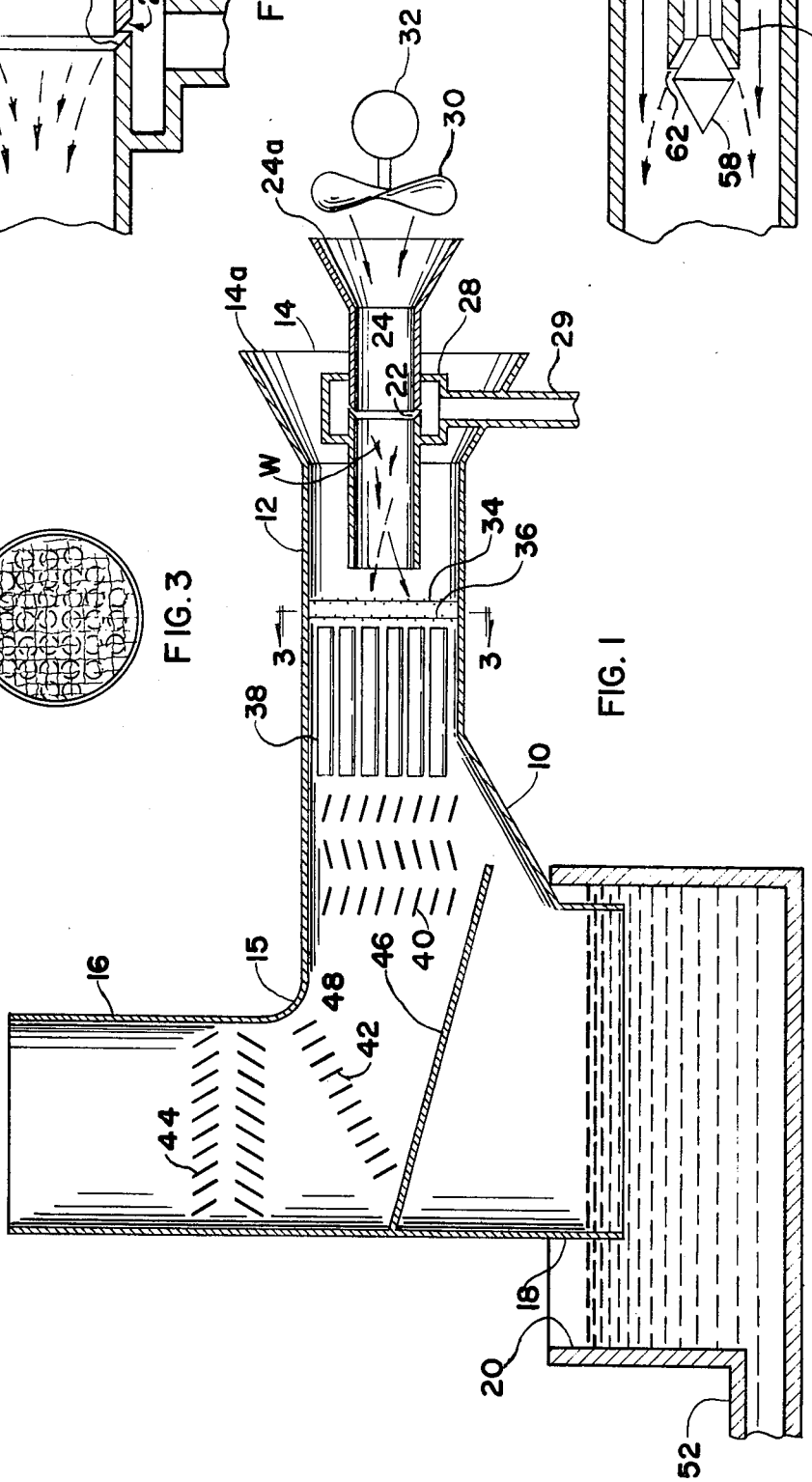
FIG. 1 is a vertical section view of a water cooling system embodying features of this invention.

The Embodiment of FIGS. 1, 2 and 3

Referring now to FIGS. 1, 2 and 3 with greater particularity, the water cooling system 10 of this invention comprises a generally horizontal air tunnel or duct 12 which is open at one end 14 to the atmosphere and terminates in a Tee 15 at the other end to form an upwardly extending air exhaust stack 16 and a depending water deposit duct 18 for conveying the cooled water to a suitable reservoir 20.

At the open upstream end of the duct 12 and disposed coaxially therewith is an annular nozzle 22 formed by two sections of a venturi tube 24 having complementary chamfered male and female ends 25 and 26, which are closely spaced and positioned in line, whereby a conical sheet of water is jetted between the two parts in a downstream direction controlled by the angle of the chamfer as indicated by the arrows W. Encircling the venturi tube 24 is the annular hot water distribution chamber 28 which positions the two parts of the venturi tube 24 with respect to each other to form the annular nozzle 22, and provides a water jacket which receives hot water from inlet pipe 29 and distributes it around the outside diameter of the venturi tube 24 to the entire circumference of the annular nozzle opening 22. Hot water flow W through the annular nozzle 22 is controlled by adjustment of the width of the chamfered gap between them, as by axial adjustment of end 25 on the water distribution chamber.

As shown most clearly in FIG. 2, the nozzle opening 22, formed by the male and female chamfered ends 25 and 26 of the two parts of the venturi tube 24, is directed downstream in the venturi tube 24 whereby a low pressure area is generated in the upstream end of venturi tube behind the conical water jet W, to draw in air as indicated by the arrows A through the flared opening 24*a* of the venturi. Then, as the air-water mixture exits from the venturi tube 24 at high velocity into the outer duct 12, a secondary venturi effect is created in the upstream end of duct 12 pulling in more cold air through the flared opening 14*a*.

If desired, the flow of outside air into openings 24*a* and 14*a* may be augmented by suitable fan means 30 which may be driven by a motor 32, but for most installations the fan will not be required.

As the water-air mixture moves downstream through the air duct 12 it passes through a series of screens or the like 34 and 36 which break up the water into a smaller droplets providing an intimate mixture with a maximum surface exposure to the entrained air. In addition if desired, the entrained air-water mixture may pass through and around a cluster of tubes 38 nested in, and extending lengthwise of the air duct 12. The tubes 38 function both as a heat exchanger and to keep the water drops separated against depositing at the bottom of the air duct 12 so that contact with the air is maximized through the full length of the air duct 12.

As the water-air mixture moves downstream the air becomes expanded through absorbtion of heat from the entrained hot water droplets resulting in a pressure increase within the heat exchanger section. The transfer of heat energy from water to air is facilitated by the increased pressure due to the more intimate contact between water and air molecules, which being under compression are denser.

Further, the pressure increase due to expansion of the heated air accelerates the movement of the air-water mixture through the system, preventing premature precipitation of the entrained water droplets as they pass through the screens 34 and 36 and the tubes 38 of the heat exchange section.

From the tubes 38 the stream may then be directed through a series of baffles or louvers 40, 42 and 44, which act as heat exchange surfaces and in addition, cause a series of moderate changes in direction of the moving air-water mixture. As a result thereof, the water droplets are subjected to inertial and centrifugal forces which separates them from the entrained air and they fall to the inclined bottom 46 of the chamber 48 over which they cascade downward into the cold water reservoir 20 and out through the cold water return pipe 52 for return to the source (not shown).

At the same time the air stream is moving upward through the baffles 42 and 44 to exit through the exhaust stack 16.

Figure 4:
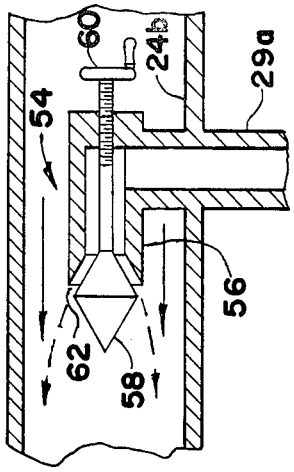
FIG. 4 is a vertical cross section of another or alternative embodiment of the injector nozzle and venturi portion of this invention.

The Embodiment of FIG. 4

Referring now to FIG. 4, the alternative nozzle 54 may take the form of a pipe 56 which is directed downstream from the incoming water pipe 29*a* with a conical nozzle control 58 disposed therein. Adjustment means 60 may be provided to fix the size of the jet opening 62. Preferably, the annular nozzle 54 is disposed coaxially within the venturi tube 24*b*.

While this invention has been described in conjunction with preferred embodiments thereof, it is obvious that modifications and changes therein may be made by those skilled in the art without departing from the spirit and scope of this invention.

What is claimed as the invention is:

1. A liquid cooling heat transfer system comprising:
   - a large, generally horizontal air duct positioned near ground level and open to ambient air at the upstream end thereof:
   - a venturi tube positioned in said air duct along the axis thereof near said upstream end:
   - annular nozzle means through said venturi tube conditioned to jet liquid downstream thereof in a converging conical path;
   - an annular duct sealed around said venturi tube in communication with said annular nozzle means;
   - a liquid conduit connecting a source of warm liquid to said annular duct;
   - a multiplicity of limited capacity separator ducts arranged across said air duct and extending along a portion of the length thereof downstream of said venturi tube to cause liquid particles moving downstream through said air duct to flow along separated paths; and
   - means at the downstream end of said air duct for separating and collecting liquid from an air stream flowing therethrough.

2. The heat transfer system defined by claim 1 wherein said separator ducts comprise:
   - a plurality of tubes extending lengthwise of said air duct to form separated flow paths.

3. The heat transfer system defined by claim 1 including:
   - a generally vertical exhaust stack at the downstream end of said air duct; and
   - a liquid collector at the base of said exhaust stack.

4. The heat transfer system defined by claim 1 wherein:
   - said annular nozzle means is a continuous slot around said venturi tube.

5. The heat transfer system defined by claim 1 including:
   - means in said air duct for fractionalizing liquid droplets in an air-liquid stream flowing therethrough.

6. The heat transfer system defined by claim 5 wherein said last-named means comprises:
   - a mesh screen across said air duct.

7. The heat transfer system defined by claim 6 wherein;
   - said mesh screen is disposed between said venturi tube and said separator ducts.

* * * * *